US008862293B2

(12) United States Patent
Hara et al.

(10) Patent No.: US 8,862,293 B2
(45) Date of Patent: Oct. 14, 2014

(54) SHIP STEERING DEVICE AND SHIP STEERING METHOD

(75) Inventors: Naohiro Hara, Osaka (JP); Akiyoshi Hayashi, Osaka (JP); Toshimitsu Hirose, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 0 days.

(21) Appl. No.: 14/129,832

(22) PCT Filed: Mar. 29, 2012

(86) PCT No.: PCT/JP2012/058431

§ 371 (c)(1),
(2), (4) Date: Feb. 4, 2014

(87) PCT Pub. No.: WO2013/001875

PCT Pub. Date: Jan. 3, 2013

(65) Prior Publication Data

US 2014/0156124 A1 Jun. 5, 2014

(30) Foreign Application Priority Data

Jun. 28, 2011 (JP) ..... 2011-143538
Jun. 30, 2011 (JP) ..... 2011-146742

(51) Int. Cl.
*B63H 25/42* (2006.01)
*B63H 5/08* (2006.01)
*B63H 21/21* (2006.01)

(52) U.S. Cl.
CPC ..... *B63H 5/08* (2013.01); *B63H 25/42* (2013.01); *B63H 21/213* (2013.01)
USPC ..... 701/21

(58) Field of Classification Search
CPC ..... B63H 25/42; B63H 5/08; B63H 21/213
USPC ..... 701/21
See application file for complete search history.

(56) References Cited

U.S. PATENT DOCUMENTS 6,298,824 B1 * 10/2001 Suhre ..... 123/406.49
6,855,020 B2 * 2/2005 Kaji ..... 440/84

(Continued)

FOREIGN PATENT DOCUMENTS

JP 2005-114160 A 4/2005
JP 2005-200004 A 7/2005

(Continued)

*Primary Examiner* — Mary Cheung
*Assistant Examiner* — Frederick Brushaber
(74) *Attorney, Agent, or Firm* — Sterne, Kessler, Goldstein & Fox P.L.L.C.

(57) ABSTRACT

A ship steering device capable of steering a hull in an intended direction by correcting an unintended rotation that occurs during an oblique sailing operation regardless of the type and size of the hull. A ship steering device is provided with an elevation angle sensor for detecting the elevation angle α of a hull, a hull speed sensor for detecting the speed V of the hull, a storage means storing the relation among the elevation angle α of the hull, the speed V of the hull, and a correction value K, and a calculation means serving as a correction value determination means, and an operation amount by which a joystick is operated such that the hull does not turn in the state in which the hull is obliquely sailed is determined by the calculation means and used as the correction value K.

1 Claim, 12 Drawing Sheets

(56) References Cited

U.S. PATENT DOCUMENTS

| | | | | |
|---|---|---|---|---|
| 6,994,046 | B2 * | 2/2006 | Kaji et al. | 114/144 R |
| 7,601,040 | B2 * | 10/2009 | Morvillo | 440/1 |
| 8,069,802 | B2 * | 12/2011 | Morvillo | 114/151 |
| 8,170,735 | B2 * | 5/2012 | Kaji | 701/21 |
| 8,613,634 | B2 * | 12/2013 | Morvillo | 440/40 |
| 2005/0059521 | A1 | 3/2005 | Funato et al. | |
| 2007/0017426 | A1 * | 1/2007 | Kaji et al. | 114/144 RE |
| 2010/0022146 | A1 * | 1/2010 | Morvillo | 440/84 |
| 2010/0138083 | A1 | 6/2010 | Kaji | |
| 2010/0145558 | A1 * | 6/2010 | Kaji | 701/21 |
| 2010/0256845 | A1 | 10/2010 | Mizutani et al. | |
| 2011/0137499 | A1 | 6/2011 | Sakaguchi et al. | |

FOREIGN PATENT DOCUMENTS

| | | | |
|---|---|---|---|
| JP | 2010-126085 | A | 6/2010 |
| JP | 2010-241238 | A | 10/2010 |
| JP | 2011-121384 | A | 6/2011 |

* cited by examiner

SHIP STEERING DEVICE AND SHIP STEERING METHOD

TECHNICAL FIELD

The present invention relates to a ship steering device and a ship steering method.

BACKGROUND ART

Conventionally, a ship is known having an inboard motor (inboard engine, outboard drive) in which a pair of left and right engines are arranged inside a hull and power is transmitted to a pair of left and right outdrive devices arranged outside the hull. The outdrive devices are propulsion devices rotating screw propellers so as to propel the hull, and are rudder devices rotated concerning a traveling direction of the hull so as to make the hull turn.

Such outdrive devices are rotated with hydraulic steering actuators provided in the outdrive devices (for example, see the Patent Literature 1). Then, a rotation angle of each of the outdrive devices, that is, a steering angle is grasped based on detection results of an angle detection sensor and the like provided in a linkage mechanism constituting the outdrive device.

The ship has an operation means setting a traveling direction of the ship. The ship is controlled with a control device so as to travel to the direction set with the operation means.

However, when the operation means is operated so as to make the ship sail obliquely, a pressure center of the hull is not in agreement with a centroid of the hull, whereby a lifting power is generated at a position of the hull shifted from the centroid. Accordingly, unintended rotation of the hull (yawing, turning) is caused. Since the influence is different concerning type, size and apparatus mounting position of the hull, a suitable correction value for canceling the unintended rotation of the hull cannot be determined uniquely. Accordingly, it is necessary to determine the suitable correction value for canceling the unintended rotation of the hull about each ship.

The ship described in the Patent Literature 1 is constructed so as to be moved laterally with propulsion power of a pair of outdrive devices by forward rotation of one of the outdrive devices and reverse rotation of the other outdrive device.

In such a ship, for making the ship move laterally without turning, it is necessary to make a resultant of the propulsion power of the left outdrive device and the propulsion power of the right outdrive device (hereinafter, referred to as "total propulsion power") act on the centroid of the hull. For making the total propulsion power act on the centroid of the hull, it is necessary to rotate the left outdrive device and the right outdrive device respectively so as to make an intersection of the direction of the propulsion power of the left outdrive device and the direction of the propulsion power of the right outdrive device in agreement with the centroid of the hull. When the intersection of the direction of the propulsion power of the left outdrive device and the direction of the propulsion power of the right outdrive device is not in agreement with the centroid of the hull, the total propulsion power does not act on the centroid of the hull, whereby the ship is not moved laterally and is turned.

In such a ship, for making the ship move laterally without turning, it is necessary to make the total propulsion power act on a direction to which the lateral movement of the ship is required. For making the total propulsion power act on the direction to which the lateral movement of the ship is required, it is necessary to make the propulsion power of the left outdrive device equal to the direction of the propulsion power of the right outdrive device. When the propulsion power of the left outdrive device is not equal to the direction of the propulsion power of the right outdrive device, the total propulsion power does not act on the direction to which the lateral movement of the ship is required, whereby the ship is not moved laterally and is turned.

Herein, since the centroid of the hull is different in each ship, the rotation angles of the outdrive devices at the time at which the intersection of the direction of the propulsion power of the left outdrive device and the direction of the propulsion power of the right outdrive device is in agreement with the centroid of the hull (hereinafter, referred to as "reference steering angle") must be set corresponding to each ship. In the outdrive devices, the propulsion power generated by forward rotation is different from that generated by reverse rotation even if the rotation speed is common, whereby a ratio of the rotation speed of the left outdrive device and the rotation speed of the right outdrive device at the time at which the propulsion power of the left outdrive device is equal to the direction of the propulsion power of the right outdrive device (hereinafter, referred to as "reference propulsion power ratio") must be set corresponding to each ship. Furthermore, since the reference steering angle and the reference propulsion power ratio are influenced of the shape of the hull and the weight of the ship intricately, the reference steering angle and the reference propulsion power ratio must be set by actual sailing of the ship, whereby an art is required for controlling the ship so as to perform the lateral movement easily.

Patent Literature 1: the Japanese Patent Laid Open Gazette 2005-114160

DISCLOSURE OF INVENTION

Problems to be Solved by the Invention

In consideration of the above problems, the purpose of the present invention is to provide a ship steering device capable of steering a hull in an intended direction by correcting an unintended rotation that occurs during an oblique sailing operation regardless of the type and size of the hull.

The purpose of the present invention is to provide a ship steering method controlling the ship so as to perform the lateral movement easily.

Means for Solving the Problems

The problems to be solved by the present invention have been described above, and subsequently, the means of solving the problems will be described below.

According to the present invention, a ship steering device includes a pair of left and right engines, rotation speed changing actuators independently changing engine rotation speeds of the pair of left and right engines, a pair of left and right outdrive devices respectively connected to the pair of left and right engines and rotating screw propellers so as to propel a hull, forward/reverse switching clutches disposed between the engines and the screw propellers, a pair of left and right steering actuators respectively independently rotating the pair of left and right outdrive devices laterally, an operation means setting a traveling direction of a ship, an operation amount detection means detecting the operation amount of the operation means, and a control device controlling the rotation speed changing actuators, the forward/reverse switching clutches, and the steering actuators so as to travel to a direction set by the operation means. The ship steering device further includes an elevation angle detection means detecting an elevation angle of the hull, a hull speed detection means detecting a speed of the hull, a storage means in which a relation among the elevation angle of the hull, the speed of the hull, and a correction value is stored, and a correction value determination means. The correction value is determined by the correction value determination means based on the operation amount by which the operation means is operated such that the hull does not turn in a state in which the hull is obliquely sailed.

According to the present invention, a ship steering device includes a pair of left and right engines, rotation speed changing actuators independently changing engine rotation speeds of the pair of left and right engines, a pair of left and right outdrive devices respectively connected to the pair of left and right engines and rotating screw propellers so as to propel a hull, forward/reverse switching clutches disposed between the engines and the screw propellers, a pair of left and right steering actuators respectively independently rotating the pair of left and right outdrive devices laterally, an operation means setting a traveling direction of a ship, an operation amount detection means detecting the operation amount of the operation means, and a control device controlling the rotation speed changing actuators, the forward/reverse switching clutches, and the steering actuators so as to travel to a direction set by the operation means. The ship steering device further includes an elevation angle detection means detecting an elevation angle of the hull, a propulsion power calculation means for the outdrive devices, a storage means in which a relation among the elevation angle of the hull, the speed of the hull, and a correction value is stored, and a correction value determination means. The correction value is determined by the correction value determination means based on the operation amount by which the operation means is operated such that the hull does not turn in a state in which the hull is obliquely sailed.

According to the present invention, a ship steering device includes a pair of left and right engines, rotation speed changing actuators independently changing engine rotation speeds of the pair of left and right engines, a pair of left and right outdrive devices respectively connected to the pair of left and right engines and rotating screw propellers so as to propel a hull, forward/reverse switching clutches disposed between the engines and the screw propellers, a pair of left and right steering actuators respectively independently rotating the pair of left and right outdrive devices laterally, an operation means setting a traveling direction of a ship, an operation amount detection means detecting an operation amount of the operation means, and a control device controlling the rotation speed changing actuators, the forward/reverse switching clutches, and the steering actuators so as to travel to a direction set by the operation means. The ship steering device further includes a rotation speed detection means for the outdrive devices, a lateral rotation angle detection means for the outdrive devices, a propulsion power vector calculation means calculating propulsion power vectors from rotation speeds and lateral rotation angles of the outdrive devices, a storage means in which a relation among propulsion power of the hull obtained from norms of the propulsion power vectors, an elevation angle of the hull obtained from angles of the propulsion power vectors, and a correction value is stored, and a correction value determination means. The correction value is determined by the correction value determination means based on the operation amount by which the operation means is operated such that the hull does not turn in a state in which the hull is obliquely sailed.

According to the present invention, in a steering method for a ship having a pair of left and right outdrive devices rotatable laterally and sailing with propulsion power of the outdrive devices, an operation means for actuating the outdrive devices, a confirmation means operated the leftward or rightward lateral movement of the ship is confirmed, and a control device to which the outdrive devices, the operation means and the confirmation means are connected are used. The operation means is operated and the outdrive devices are actuated so as to move the ship leftward and rightward. The confirmation means is operated when the leftward or rightward lateral movement of the ship is confirmed. Rotation angles of the outdrive devices at a time of operating the confirmation means is presumed with the control device.

According to the present invention, a first rotation speed detection sensor detecting the rotation speed of one of the outdrive devices, a second rotation speed detection sensor detecting the rotation speed of the other outdrive device, and the control device to which the first and second rotation speed detection sensors are connected are used, and a ratio of the rotation speed of one of the outdrive devices and the ratio of the rotation speed of the other outdrive device at the time of operating the confirmation means is presumed with the control device.

Effect of the Invention

According to the present invention, the hull can be steered to the intended direction by correcting an unintended rotation that occurs during an oblique sailing operation regardless of the type and size of the hull.

Only by operating the operation means and the confirmation means, the reference steering angle at the time of lateral movement of the ship is set. Accordingly, the ship can be set easily to move laterally.

Only by operating the operation means and the confirmation means, the reference propulsion power ratio at the time of lateral movement of the ship is set. Accordingly, the ship can be set easily to move laterally.

DESCRIPTION OF NOTATIONS

1 ship steering device
2 hull
3A and 3B engines
4A and 4B rotation speed changing actuators
10A and 10B outdrive devices
15A and 15B screw propellers
16A and 16B forward/reverse switching clutches
17A and 17B hydraulic steering actuators (steering actuators)
21 joystick (operation means)
31 control device
36 elevation angle sensor (elevation angle detection means)
37 hull speed sensor (hull speed detection means)
38A and 38B lateral rotation angle detection sensors (lateral rotation angle detection means)
39 operation amount detection sensor (operation amount detection means)
40A and 40B outdrive device rotation speed detection sensor (rotation speed detection means for outdrive devices)
$N_A$ and $N_B$ engine rotation speeds
$ND_A$ and $ND_B$ outdrive device rotation speeds
θA and θB rotation angles of outdrive devices
TA' and TB' propulsion power vectors
$T_A$ and $T_B$ propulsion powers
α elevation angle
V hull speed
K correction value

DETAILED DESCRIPTION OF THE INVENTION

Firstly, an explanation will be given on a ship steering device according to an embodiment of the present invention.

Figure 1:
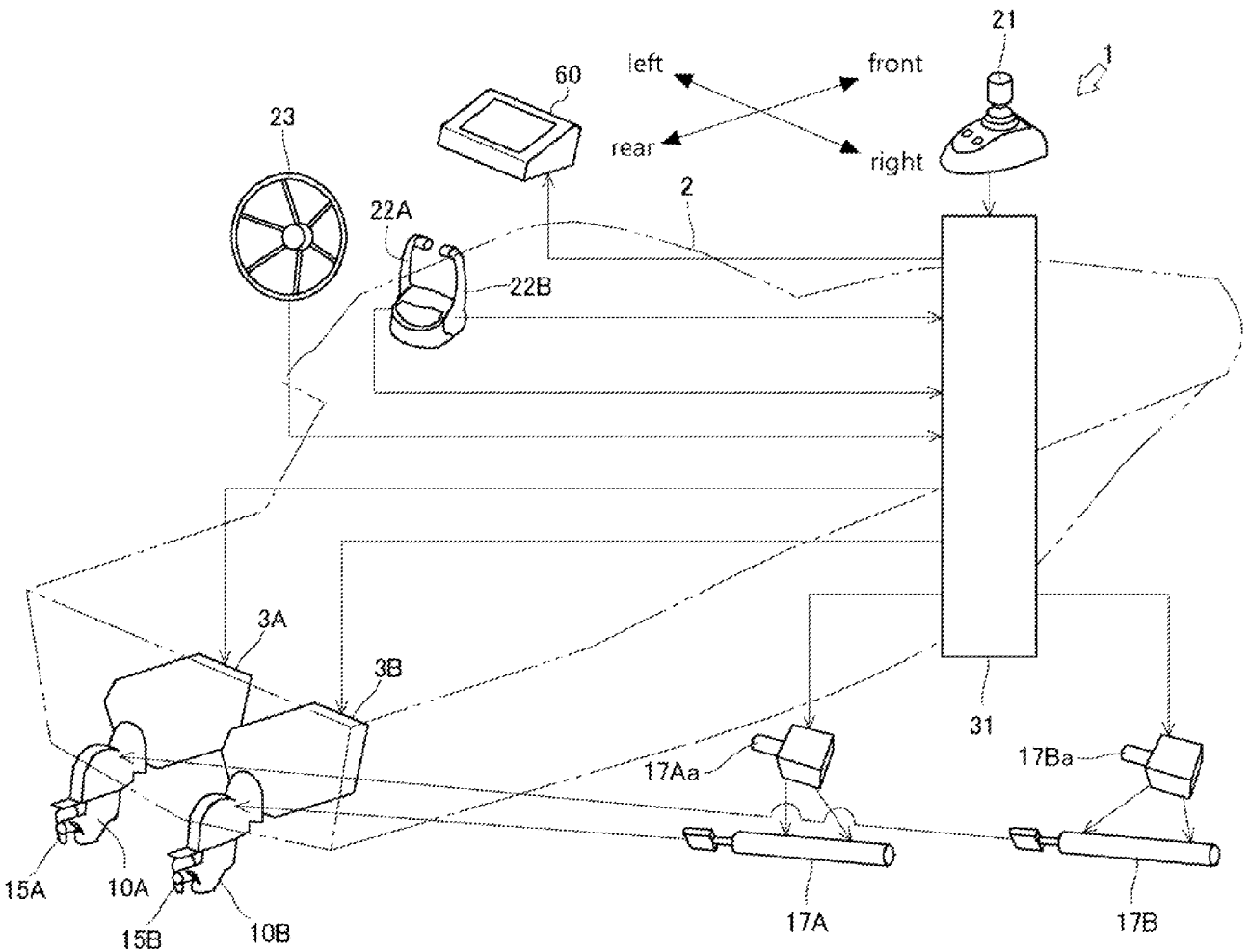
FIG. 1 is a drawing of a ship according to an embodiment of the present invention.
Figure 2:
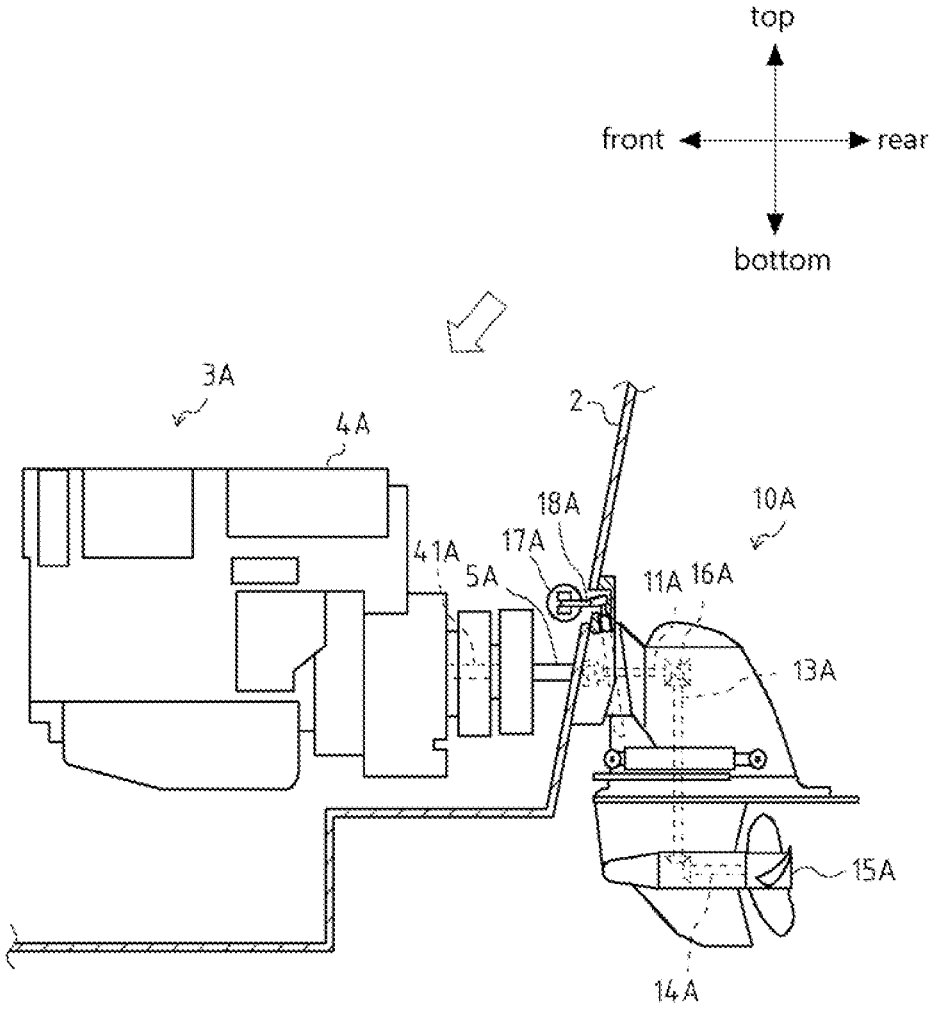
FIG. 2 is a left side view partially in section of an outdrive device according to the embodiment of the present invention.
Figure 3:
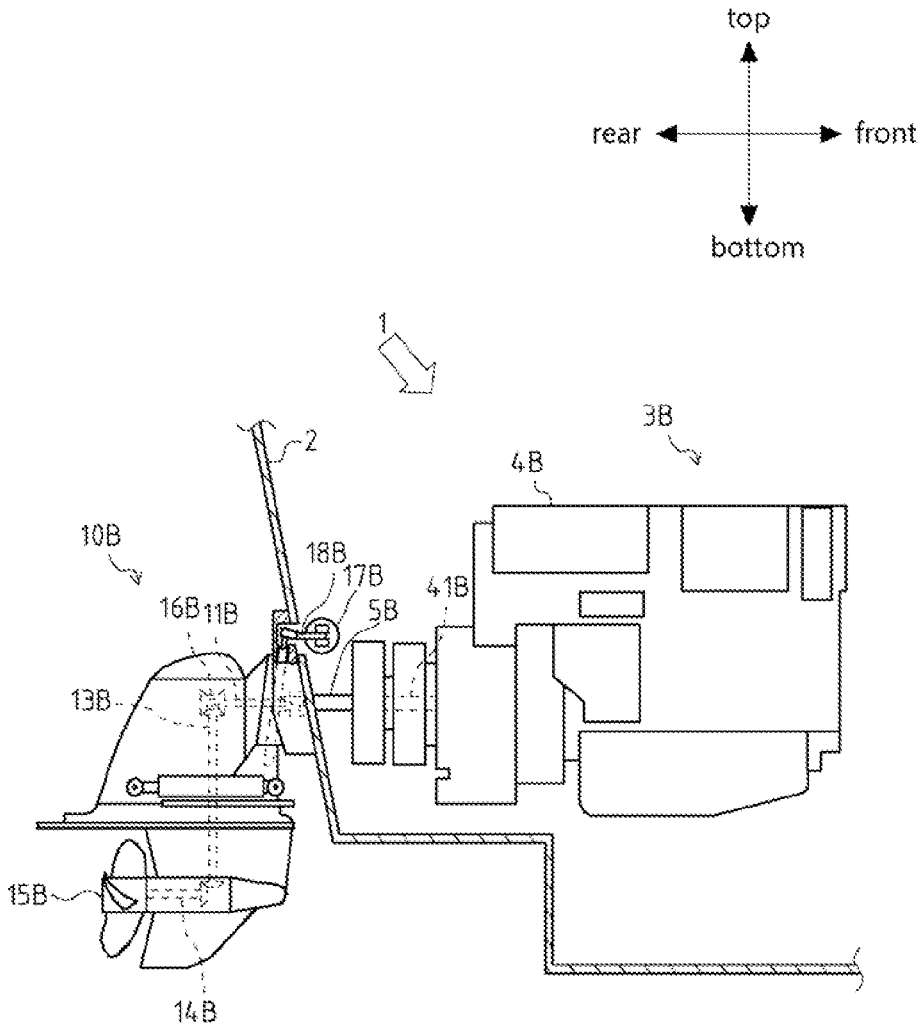
FIG. 3 is a right side view partially in section of the outdrive device according to the embodiment of the present invention.

As shown in FIGS. 1, 2 and 3, a ship steering device 1 has a pair of left and right engines 3A and 3B, rotation speed changing actuators 4A and 4B independently changing engine rotation speeds $N_A$ and $N_B$ of the pair of left and right engines 3A and 3B, a pair of left and right outdrive devices 10A and 10B respectively connected to the pair of left and right engines 3A and 3B and rotating screw propellers 15A and 15B so as to propel a hull 2, forward/reverse switching clutches 16A and 16B disposed between the engines 3A and 3B and the screw propellers 15A and 15B, a pair of left and right hydraulic steering actuators 17A and 17B respectively independently rotating the pair of left and right outdrive devices 10A and 10B laterally, electromagnetic valves 17Aa and 17Ba controlling hydraulic pressure in the hydraulic steering actuators 17A and 17B, a joystick 21, accelerator levers 22A and 22B and an operation wheel 23 as operation means setting a traveling direction of the ship, an operation amount detection sensor 39 (see FIG. 5) as an operation amount detection means detecting an operation amount of the joystick 21, operation amount detection sensor 43A and 43B (see FIG. 5) as operation amount detection means detecting operation amounts of the accelerator levers 22A and 22B, an operation amount detection sensor 44 (see FIG. 5) as an operation amount detection means detecting an operation amount of the operation wheel 23, and a control device 31 (see FIG. 5) controlling the rotation speed changing actuators 4A and 4B, the forward/reverse switching clutches 16A and 16B, the hydraulic steering actuators 17A and 17B and the electromagnetic valves 17Aa and 17Ba so as to travel to a direction set by the joystick 21, the accelerator levers 22A and 22B and the operation wheel 23.

The engines 3A and 3B are arranged in a rear portion of the hull 2 as a pair laterally, and are connected to the outdrive devices 10A and 10B arranged outside the ship. The engines 3A and 3B have output shafts 41A and 41B for outputting rotation power.

The rotation speed changing actuators 4A and 4B are means controlling the engine rotation power, and changes a fuel injection amount of a fuel injection device and the like so as to control engine rotation speeds of the engines 3A and 3B.

The outdrive devices 10A and 10B are propulsion devices rotating the screw propellers 15A and 15B so as to propel the hull 2, and are provided outside the rear portion of the hull 2 as a pair laterally. The pair of left and right outdrive devices 10A and 10B are respectively connected to the pair of left and right engines 3A and 3B. The outdrive devices 10A and 10B are rudder devices which are rotated concerning the traveling direction of the hull 2 so as to make the hull 2 turn. The outdrive devices 10A and 10B mainly include input shafts 11A and 11B, the forward/reverse switching clutches 16A and 16B, drive shafts 13A and 13B, final output shaft 14A and 14B, and the rotating screw propellers 15A and 15B.

The input shafts 11A and 11B transmit rotation power. In detail, the input shafts 11A and 11B transmit rotation power of the engines 3A and 3B, transmitted from the output shafts 41A and 41B of the engines 3A and 3B via universal joints 5A and 5B, to the forward/reverse switching clutches 16A and 16B. One of ends of each of the input shafts 11A and 11B is connected to corresponding one of the universal joints 5A and 5B attached to the output shafts 41A and 41B of the engines 3A and 3B, and the other end thereof is connected to corresponding one of the forward/reverse switching clutches 16A and 16B.

The forward/reverse switching clutches 16A and 16B are arranged between the engines 3A and 3B and the rotating screw propellers 15A and 15B, and switch rotation direction of the rotation power. In detail, the forward/reverse switching clutches 16A and 16B are rotation direction switching devices which switch the rotation power of the engines 3A and 3B, transmitted via the input shafts 11A and 11B and the like, to forward or reverse direction. The forward/reverse switching clutches 16A and 16B have forward bevel gears and reverse bevel gears which are connected to inner drums having disc plates, and pressure plates of outer drums connected to the input shafts 11A and 11B is pressed against the disc plates of the forward bevel gears or the reverse bevel gears so as to switch the rotation direction.

The drive shafts 13A and 13B transmit the rotation power. In detail, the drive shafts 13A and 13B are rotation shafts which transmit the rotation power of the engines 3A and 3B, transmitted via the forward/reverse switching clutches 16A and 16B and the like, to the final output shaft 14A and 14B. A bevel gear provided at one of ends of each of the drive shafts 13A and 13B is meshed with the forward bevel gear and the reverse bevel gear provided on corresponding one of the forward/reverse switching clutches 16A and 16B, and a bevel gear provided at the other end is meshed with a bevel gear provided on corresponding one of the final output shaft 14A and 14B.

The final output shaft 14A and 14B transmit the rotation power. In detail, the final output shaft 14A and 14B are rotation shafts which transmit the rotation power of the engines 3A and 3B, transmitted via the drive shafts 13A and 13B and the like, to the screw propellers 15A and 15B. As mentioned above, the bevel gear provided at one of ends of each of the final output shaft 14A and 14B is meshed with the bevel gear of corresponding one of the drive shafts 13A and 13B, and the other end is attached thereto with corresponding one of the screw propellers 15A and 15B.

The screw propellers 15A and 15B are rotated so as to generate propulsion power. In detail, the screw propellers 15A and 15B are driven by the rotation power of the engines 3A and 3B transmitted via the final output shaft 14A and 14B and the like so that a plurality of blades arranged around the rotation shafts paddle surrounding water, whereby the propulsion power is generated.

The hydraulic steering actuators 17A and 17B are hydraulic devices which drive steering arms 18A and 18B so as to rotate the outdrive devices 10A and 10B. The hydraulic steering actuators 17A and 17B are provided therein with the electromagnetic valves 17Aa and 17Ba for controlling hydraulic pressure, and the electromagnetic valves 17Aa and 17Ba are connected to the control device 31.

The hydraulic steering actuators 17A and 17B are so-called single rod type hydraulic actuators. However, the hydraulic steering actuators 17A and 17B may alternatively be double rod type.

The joystick 21 as the operation means is a device determining the traveling direction of the ship, and is provided near an operator's seat of the hull 2. A plane operation surface of the joystick 21 is an oblique sailing component determination part 21*a*, and a torsion operation surface thereof is a turning component determination part 21*b*.

Figure 4:
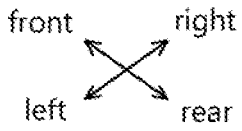
FIG. 4 is a drawing of an operation device.
Figure 4:
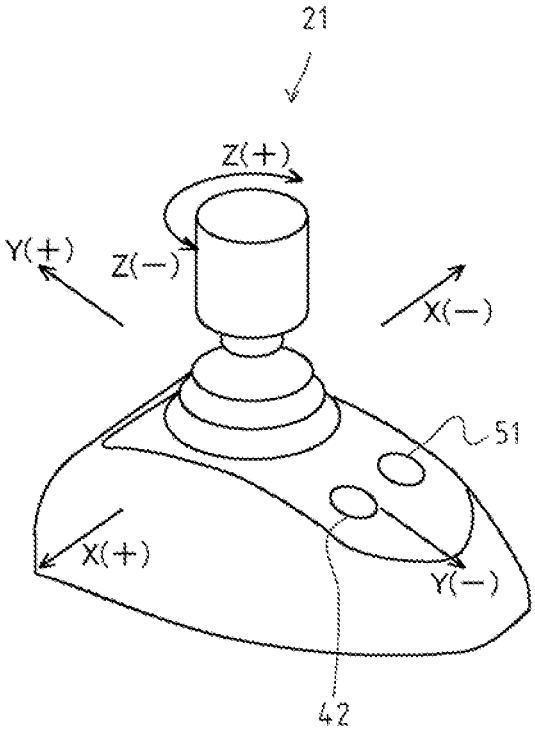

The joystick 21 can be moved free within the operation surface parallel to an X-Y plane shown in FIG. 4, and a center of the operation surface is used as a neutral starting point. Longitudinal and lateral directions in the operation surface correspond to the traveling direction, and an inclination amount of the joystick 21 corresponds to a target hull speed. The target hull speed is increased corresponding to increase of the inclination amount of the joystick 21.

The torsion operation surface is provided with the joystick 21, and by twisting the joystick 21 concerning a Z axis extended substantially perpendicularly to the plane operation surface as a turning axis, a turning speed can be changed. A torsion amount of the joystick 21 corresponds to a target turning speed. A maximum target lateral turning speed is set at fixed turning angle positions of the joystick 21.

The accelerator levers 22A and 22B as the operation means are devices determining the target hull speed of the ship, and are provided near the operator's seat of the hull 2. The two accelerator levers 22A and 22B are provided so as to correspond respectively to the left and right engines 3A and 3B. The rotation speed of the engine 3A is changed by operating the accelerator lever 22A, and the rotation speed of the engine 3B is changed by operating the accelerator lever 22B.

The operation wheel 23 as the operation means is a device determining the traveling direction of the ship, and is provided near the operator's seat of the hull 2. The traveling direction is changed widely following increase of a rotation amount of the operation wheel 23.

A correction control start switch 42 (see FIG. 5) is a switch for starting correction control of turning action of the hull 2.

The correction control start switch 42 is provided near the joystick 21 and is connected to the control device 31.

A lateral movement control start switch 51 (see FIG. 5) is a switch for starting control of determination of a reference value of lateral movement of the hull 2. The lateral movement control start switch 51 is provided near the joystick 21 and is connected to the control device 31.

A display monitor 60 as a display means is a device displaying completion of the correction control of turning action of the hull 2 and the control of determination of reference value of lateral movement of the hull 2. The display monitor 60 is provided near the operator's seat of the hull 2.

Figure 5:
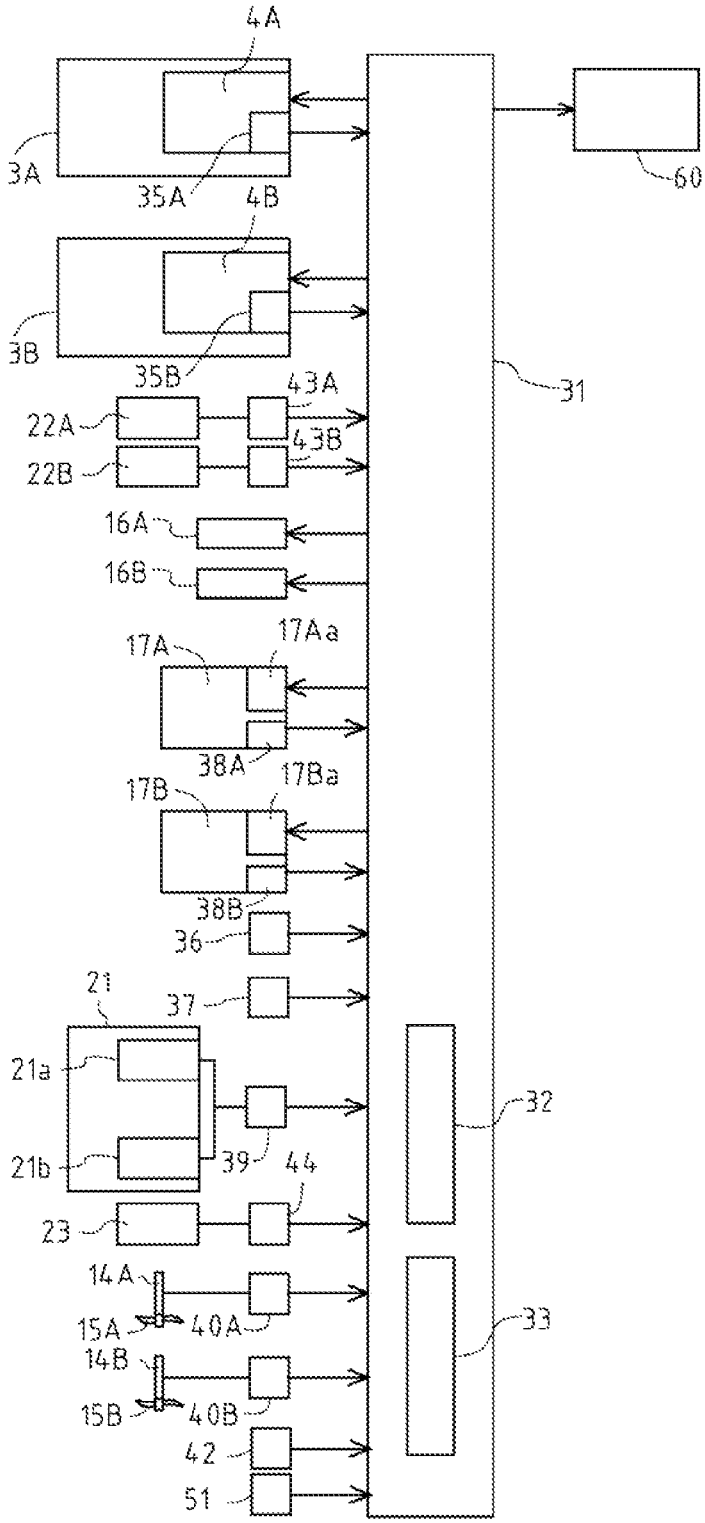
FIG. 5 is a block diagram of a control device.

Next, an explanation will be given on various kinds of detection means referring to FIG. 5.

Rotation speed detection sensors 35A and 35B as rotation speed detection means are means for detecting engine rotation speeds $N_A$ and $N_B$ of the engines 3A and 3B and are provided in the engines 3A and 3B.

An elevation angle sensor 36 as an elevation angle detection means is a means for detecting an elevation angle $\alpha$ of the hull 2. The elevation angle indicates inclination of the hull in the water concerning a flow.

A hull speed sensor 37 as a hull speed detection means is a means for detecting a hull speed V, and is an electromagnetic log, a Doppler sonar or a GPS for example.

Lateral rotation angle detection sensors 38A and 38B as lateral rotation angle detection means are means for detecting lateral rotation angles $\theta_A$ and $\theta_B$ of the outdrive devices 10A and 10B. The lateral rotation angle detection sensors 38A and 38B are provided near the hydraulic steering actuators 17A and 17B, and detect the lateral rotation angles $\theta_A$ and $\theta_B$ of the outdrive devices 10A and 10B based on the drive amounts of the hydraulic steering actuators 17A and 17B.

The operation amount detection sensor 39 as the operation amount detection means is a sensor for detecting the operation amount in the plane operation surface and the operation amount in the torsion operation surface of the joystick 21. The operation amount detection sensor 39 detects an inclination angle and an inclination direction of the joystick 21. The operation amount detection sensor 39 detects the torsion amount of the joystick 21.

The operation amount detection sensors 43A and 43B as the operation amount detection means are sensors for detecting the operation amounts of the accelerator levers 22A and 22B. The operation amount detection sensors 43A and 43B detect inclination angles of the accelerator levers 22A and 22B.

The operation amount detection sensor 44 as the operation amount detection means is a sensor for detecting the operation amount of the operation wheel 23. The operation amount detection sensor 44 detects the rotation amount of the operation wheel 23.

Outdrive device rotation speed detection sensors 40A and 40B as rotation speed detection means of the outdrive devices 10A and 10B are sensors for detecting rotation speeds of the screw propellers 15A and 15B of the outdrive devices 10A and 10B, and are provided at middle portions of the final output shaft 14A and 14B. The outdrive device rotation speed detection sensors 40A and 40B detect outdrive device rotation speeds $ND_A$ and $ND_B$.

The control device 31 controls the rotation speed changing actuators 4A and 4B, the forward/reverse switching clutches 16A and 16B and the hydraulic steering actuators 17A and 17B so that the ship travels to the direction set by the joystick 21. The control device 31 is connected respectively to the rotation speed changing actuators 4A and 4B, the forward/reverse switching clutches 16A and 16B, the hydraulic steering actuators 17A and 17B, the electromagnetic valves 17Aa and 17Ba, the joystick 21, the accelerator levers 22A and 22B, the operation wheel 23, the rotation speed detection sensors 35A and 35B, the elevation angle sensor 36, the hull speed sensor 37, the lateral rotation angle detection sensors 38A and 38B, the operation amount detection sensor 39, the operation amount detection sensors 43A and 43B, the operation amount detection sensor 44, and the outdrive device rotation speed detection sensors 40A and 40B. The control device 31 includes a calculation means 32 having a CPU (central processing unit) and a storage means 33 such as a ROM, a RAM or a HDD.

The calculation means 32 performs various calculations concerning ship steering control.

In the storage means 33, relation among the elevation angle α of the hull 2, the hull speed V of the hull 2, and a correction value K is stored previously.

The relation among the elevation angle α of the hull 2, the hull speed V of the hull 2, and a correction value K is indicated by below formula which finds K.

$$K=MP/V^2/C(\alpha)$$

C(α) is a moment coefficient and is a function of α.

Next, an explanation will be given on control concerning determination of the correction value K with the control device 31. The calculation means 32 of the control device 31 performs the control as a correction value determination means.

Firstly, an explanation will be given on steps of an operator before starting the control concerning the determination of the correction value K.

Figure 6:
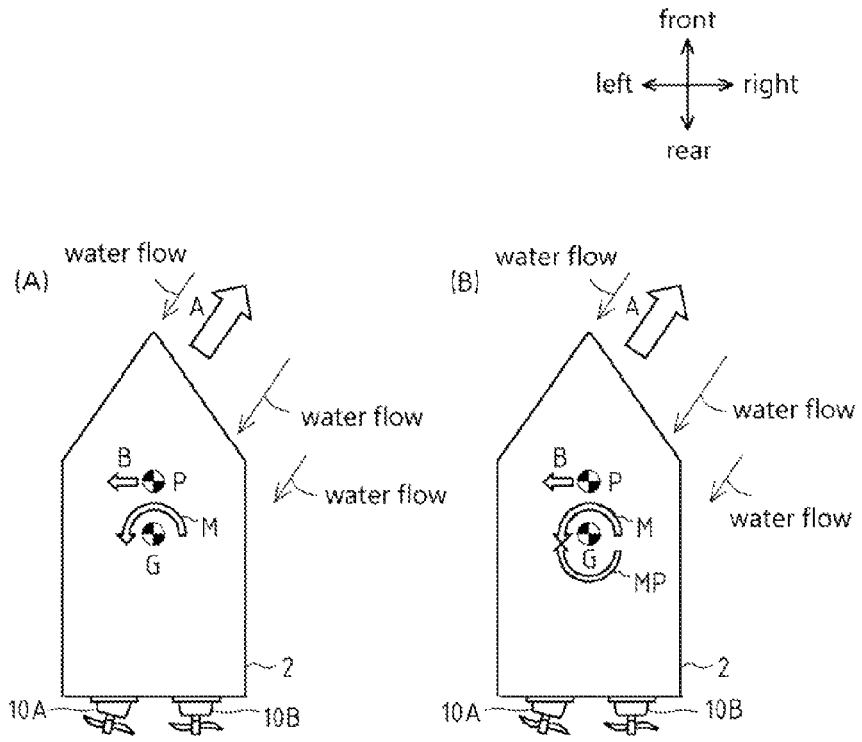
FIG. 6(A) is a drawing of power applied on a hull during oblique sailing.
FIG. 6(B) is a drawing of power applied on a hull at the time at which a turning moment is generated by the operation device.

The operator operates the joystick 21 so as to make the ship sail obliquely. The oblique sailing means movement of the ship along a fixed direction and includes longitudinal and lateral movement. For example, as shown in FIG. 6(A), when the ship sails obliquely along a direction of an arrow A, lifting power L is generated along a direction of an arrow B concerning a pressure center P of the hull 2 corresponding to the traveling direction and the traveling speed (hull speed). The lifting power L is generated because the pressure center P of the hull 2 during oblique sailing is different from a centroid G of the hull 2. By the lifting power L, a turning moment M is generated centering on the centroid G of the hull 2. In other words, by the lifting power L, the hull 2 is rotated horizontally centering on the centroid G (yawing).

Next, as shown in FIG. 6(B), for generating a turning moment MP which balances with the turning moment M generated by the lifting power L, the operator twists the joystick 21.

Subsequently, after stopping the turning of the hull 2 by the twisting operation, the correction control start switch 42 is turned on. When the correction control start switch 42 is turned on, the control concerning the determination of the correction value is started.

Figure 7:
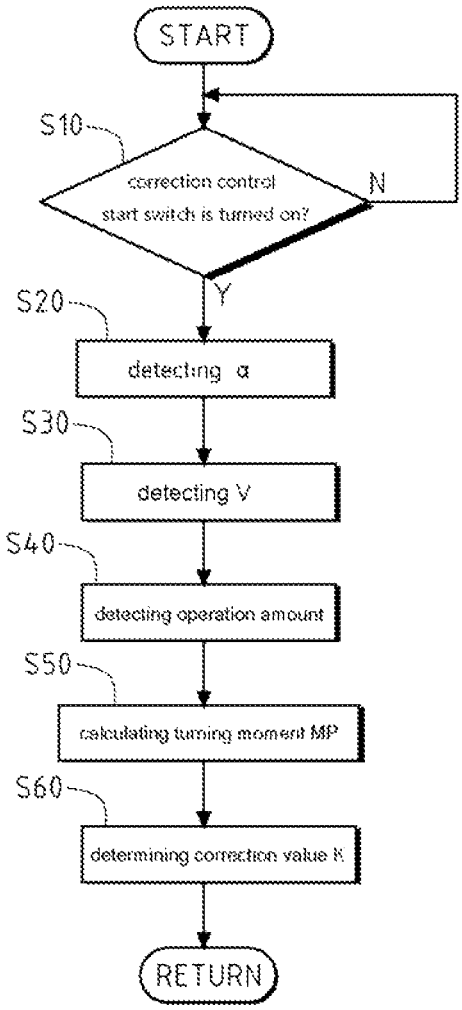
FIG. 7 is a flow chart of control of determination of a correction value.

Next, an explanation will be given on a control flow of the control concerning the determination of the correction value K referring to FIG. 7.

The control device 31 judges whether the correction control start switch 42 is turned on or not (step S10), and performs the step S10 again when the correction control start switch 42 is not turned on.

At the step S10, when the correction control start switch 42 is turned on, the elevation angle α at this time is detected with the elevation angle sensor 36 (step S20), and the hull speed V is detected with the hull speed sensor 37 (step S30). The elevation angle α and the hull speed V are stored in the storage means 33 of the control device 31.

Subsequently, a twisting amount of the joystick 21 is detected with the operation amount detection sensor 39 (step S40), and the turning moment MP based on the twisting amount is calculated with the calculation means 32 of the control device 31 (step S50). The turning moment MP is stored in the storage means 33.

The correction value K is determined based on the elevation angle α, the hull speed V and the turning moment MP with the calculation means 32 of the control device 31 (step S60).

K is indicated by below formula.

$$K=MP/V^2/C(\alpha)$$

C(α) is a moment coefficient and is a function of α.

At the step S60, after determining the correction value K, completion of the determination of the correction value K is displayed on the display monitor 60. At the time at which the display is performed, when the operator pushes the correction control start switch 42, the correction value K is stored in the storage means 33. When the correction value K is stored in the storage means 33, the correction of turning action of the hull 2, that is, a calibration is finished.

According to the operation and the calculation, the correction value K can be calculated with an easy method regardless of the size of the hull 2 and the ship. During oblique sailing of the hull 2, drive signal values of the rotation speed changing actuators 4A and 4B and the hydraulic steering actuators 17A and 17B are corrected with the correction value K, whereby the ship can travel along a target direction operated by the operator.

Second Embodiment

An explanation will be given on a method in that a dynamic pressure $\frac{1}{2}\rho V^2$ generated by the hull speed V is presumed based on the propulsion power of the outdrive devices 10A and 10B (unit N) and the hull speed V is calculated from the dynamic pressure $\frac{1}{2}\rho V^2$ instead of the hull speed V detected with the hull speed sensor 37. ρ is density of water.

Figure 8:
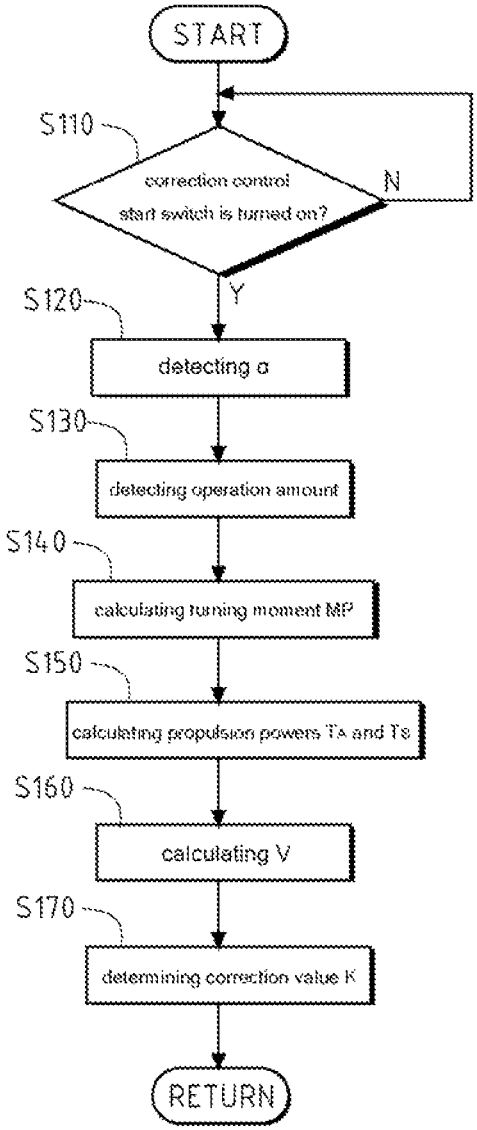
FIG. 8 is a flow chart of control of determination of a correction value according to another embodiment.

An explanation will be given on a control flow concerning the determination of the correction value K referring to FIG. 8.

The control device 31 judges whether the correction control start switch 42 is turned on or not (step S110), and performs the step S110 again when the correction control start switch 42 is not turned on.

At the step S110, when the correction control start switch 42 is turned on, the elevation angle α at this time is detected with the elevation angle sensor 36 (step S120). The elevation angle α is stored in the storage means 33 of the control device 31.

Subsequently, the twisting amount of the joystick 21 is detected with the operation amount detection sensor 39 (step S130), and the turning moment MP based on the twisting amount is calculated with the calculation means 32 of the control device 31 (step S140). The turning moment MP is stored in the storage means 33.

Then, propulsion powers $T_A$ and $T_B$ of the outdrive devices 10A and 10B are calculated with the calculation means 32 of the control device 31 (step S150). The control device 31 calculates the propulsion powers $T_A$ and $T_B$ based on an operation amount of the oblique sailing component determination part 21*a* and an operation amount of the turning component determination part 21*b* of the joystick 21 detected with the operation amount detection sensor 39. Alternatively, the propulsion powers $T_A$ and $T_B$ are calculated from the engine rotation speed.

The control device 31 calculates the dynamic pressure $\frac{1}{2}\rho V^2$ based on the propulsion powers $T_A$ and $T_B$ calculated with the calculation means 32, and calculates the hull speed V based on the dynamic pressure $\frac{1}{2}\rho V^2$ (step S160). The hull speed V is stored in the storage means 33.

The correction value K is determined based on the elevation angle α, the hull speed V and the turning moment MP with the calculation means 32 of the control device 31 (step S170).

K is indicated by below formula.

$$K=MP/V^2/C(\alpha)$$

C(α) is a moment coefficient and is a function of α.

At the step S170, after determining the correction value K, completion of the determination of the correction value K is displayed on the display monitor 60. At the time at which the display is performed, when the operator pushes the correction control start switch 42, the correction value K is stored in the storage means 33. When the correction value K is stored in the storage means 33, the calibration concerning the correction of turning action of the hull 2 is finished.

According to the operation and the calculation, the correction value K can be calculated with an easy method regardless of the size of the hull 2 and the ship. When the hull speed V cannot be detected directly, that is, when any sensor for detecting the hull speed V is not provided, the correction value K can be calculated with the easy method and costs can be reduced.

Third Embodiment

An explanation will be given on a method in that the correction value K is calculated based on propulsion power vector T' instead of the hull speed V detected with the hull speed sensor 37.

A relation among propulsion powers $T_A$ and $T_B$ obtained from norms of propulsion power vectors $T_A'$ and $T_B'$, the elevation angle α obtained from directions of the propulsion power vectors $T_A'$ and $T_B'$, and the correction value K is stored previously in the storage means 33 of the control device 31.

Figure 9:
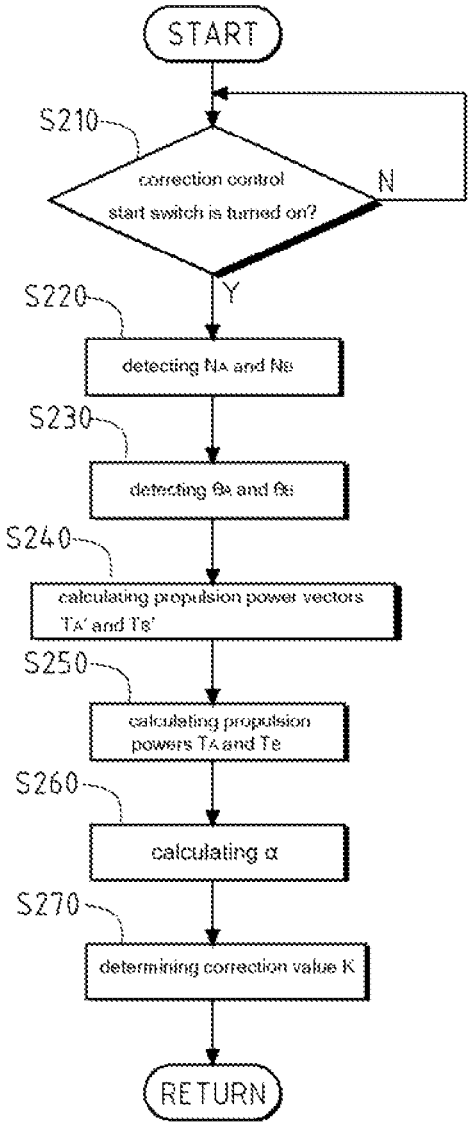
FIG. 9 is a flow chart of control of determination of a correction value according to another embodiment.

An explanation will be given on a control flow concerning the determination of the correction value K referring to FIG. 9.

The control device 31 judges whether the correction control start switch 42 is turned on or not (step S210), and performs the step S210 again when the correction control start switch 42 is not turned on.

At the step S210, when the correction control start switch 42 is turned on, the outdrive device rotation speed ND of the outdrive devices 10A and 10B at this time is detected with the outdrive device rotation speed detection sensors 40A and 40B (step S220). The outdrive device rotation speed ND is stored in the storage means 33. Next, the lateral rotation angles $\theta_A$ and $\theta_B$ of the pair of left and right outdrive devices 10A and 10B are detected with the lateral rotation angle detection sensors 38A and 38B (step S230). The lateral rotation angles $\theta_A$ and $\theta_B$ are stored in the storage means 33. Subsequently, the propulsion power vectors $T_A'$ and $T_B'$ are calculated based on the outdrive device rotation speeds $ND_A$ and $ND_B$ and the lateral rotation angles $\theta_A$ and $\theta_B$ of the pair of left and right outdrive devices 10A and 10B (step S240). The propulsion power vectors $T_A'$ and $T_B'$ are stored in the storage means 33.

Next, the propulsion powers $T_A$ and $T_B$ of the hull 2 are obtained from the norms of the propulsion power vectors $T_A'$ and $T_B'$ (step S250). The unit of the propulsion power is the second power of the engine rotation speed (unit: $min^{-2}$). The elevation angle α of the hull 2 is obtained from the directions of the propulsion power vectors $T_A'$ and $T_B'$ (step S260).

Subsequently, the calculation means 32 of the control device 31 determines the correction value K from the propulsion power T of the hull 2 obtained at the step S250 the elevation angle α of the hull 2 obtained at the step S260 with the relation among the elevation angle α of the hull 2, the hull speed V of the hull 2 and a correction value K stored previously in the storage means 33 (step S270).

At the step S270, after determining the correction value K, completion of the determination of the correction value K is displayed on the display monitor 60. At the time at which the display is performed, when the operator pushes the correction control start switch 42, the correction value K is stored in the storage means 33. When the correction value K is stored in the storage means 33, the calibration concerning the correction of turning action of the hull 2 is finished.

According to the construction, the correction value K can be calculated with an easy method regardless of the size of the hull 2 and the ship. When the hull speed V cannot be detected, the correction value K can be calculated with the easy method and costs can be reduced.

As mentioned above, the ship steering device 1 has the pair of left and right engines 3A and 3B, the rotation speed changing actuators 4A and 4B independently changing engine rotation speeds N of the pair of left and right engines 3A and 3B, the pair of left and right outdrive devices 10A and 10B respectively connected to the pair of left and right engines 3A and 3B and rotating the screw propellers 15A and 15B so as to propel the hull 2, the forward/reverse switching clutches 16A and 16B disposed between the engines 3A and 3B and the screw propellers 15A and 15B, the pair of left and right hydraulic steering actuators 17A and 17B respectively independently rotating the pair of left and right outdrive devices 10A and 10B laterally, the joystick 21 setting the traveling direction of the ship, the operation amount detection sensor 39 detecting the operation amount of the joystick 21, and the control device 31 controlling the rotation speed changing actuators 4A and 4B, the forward/reverse switching clutches 16A and 16B, and the hydraulic steering actuators 17A and 17B so as to travel to a direction set by the joystick 21. The elevation angle sensor 36 detecting the elevation angle α of the hull 2, the hull speed sensor 37 detecting the speed V of the hull 2, the storage means 33 in which the relation among the elevation angle α of the hull 2, the speed V of the hull 2, and the correction value K is stored, and the calculation means 32 as a correction value determination means are provided. The operation amount by which the joystick 21 is operated such that the hull 2 does not turn in the state in which the hull 2 is obliquely sailed is determined by the calculation means 32 and used as the correction value K.

The ship steering device 1 has the pair of left and right engines 3A and 3B, the rotation speed changing actuators 4A and 4B independently changing engine rotation speeds N of the pair of left and right engines 3A and 3B, the pair of left and right outdrive devices 10A and 10B respectively connected to the pair of left and right engines 3A and 3B and rotating the screw propellers 15A and 15B so as to propel the hull 2, the forward/reverse switching clutches 16A and 16B disposed between the engines 3A and 3B and the screw propellers 15A and 15B, the pair of left and right hydraulic steering actuators 17A and 17B respectively independently rotating the pair of left and right outdrive devices 10A and 10B laterally, the joystick 21 setting the traveling direction of the ship, the operation amount detection sensor 39 detecting the operation amount of the joystick 21, and the control device 31 controlling the rotation speed changing actuators 4A and 4B, the forward/reverse switching clutches 16A and 16B, and the hydraulic steering actuators 17A and 17B so as to travel to a direction set by the joystick 21. The elevation angle sensor 36 detecting the elevation angle α of the hull 2, the calculation means 32 as the calculation means for the propulsion power of the outdrive devices 10A and 10B and as the correction value determination means, and the storage means 33 in which the relation among the elevation angle α of the hull 2, the speed V of the hull 2, and the correction value K is stored are provided. The correction value K is determined by the calculation means 32 based on the operation amount by which the joystick 21 is operated such that the hull 2 does not turn in the state in which the hull 2 is obliquely sailed.

The ship steering device 1 has the pair of left and right engines 3A and 3B, the rotation speed changing actuators 4A and 4B independently changing engine rotation speeds N of the pair of left and right engines 3A and 3B, the pair of left and right outdrive devices 10A and 10B respectively connected to the pair of left and right engines 3A and 3B and rotating the screw propellers 15A and 15B so as to propel the hull 2, the forward/reverse switching clutches 16A and 16B disposed between the engines 3A and 3B and the screw propellers 15A and 15B, the pair of left and right hydraulic steering actuators 17A and 17B respectively independently rotating the pair of left and right outdrive devices 10A and 10B laterally, the joystick 21 setting the traveling direction of the ship, the operation amount detection sensor 39 detecting the operation amount of the joystick 21, and the control device 31 controlling the rotation speed changing actuators 4A and 4B, the forward/reverse switching clutches 16A and 16B, and the hydraulic steering actuators 17A and 17B so as to travel to a direction set by the joystick 21. The outdrive device rotation speed detection sensors 40A and 40B, the lateral rotation angle detection sensors 38A and 38B, the calculation means 32 as the propulsion power vector calculation means calculating the propulsion power vectors $T_A'$ and $T_B'$ from the outdrive device rotation speeds $ND_A$ and $ND_B$ and the lateral rotation angles $\theta_A$ and $\theta_B$ of the outdrive devices 10A and 10B and as the correction value determination means, and the storage means 33 in which the relation among the propulsion power T of the hull 2 obtained from the norms of the propulsion power vectors $T_A'$ and $T_B'$, the elevation angle α of the hull 2 obtained from the angles $\theta_A$ and $\theta_B$ of the propulsion power vectors $T_A'$ and $T_B'$, and the correction value K is stored are provided. The correction value K is determined by the calculation means 32 based on the operation amount by which the joystick 21 is operated such that the hull 2 does not turn in the state in which the hull 2 is obliquely sailed.

According to the construction, the correction value K for correcting unintended turning during the oblique sailing operation can be determined with the easy method regardless of the type and size of the hull 2 so as to make the hull 2 turn to an intended direction.

[Control Concerning Determination of Correction Value During Lateral Movement]

Figure 10:
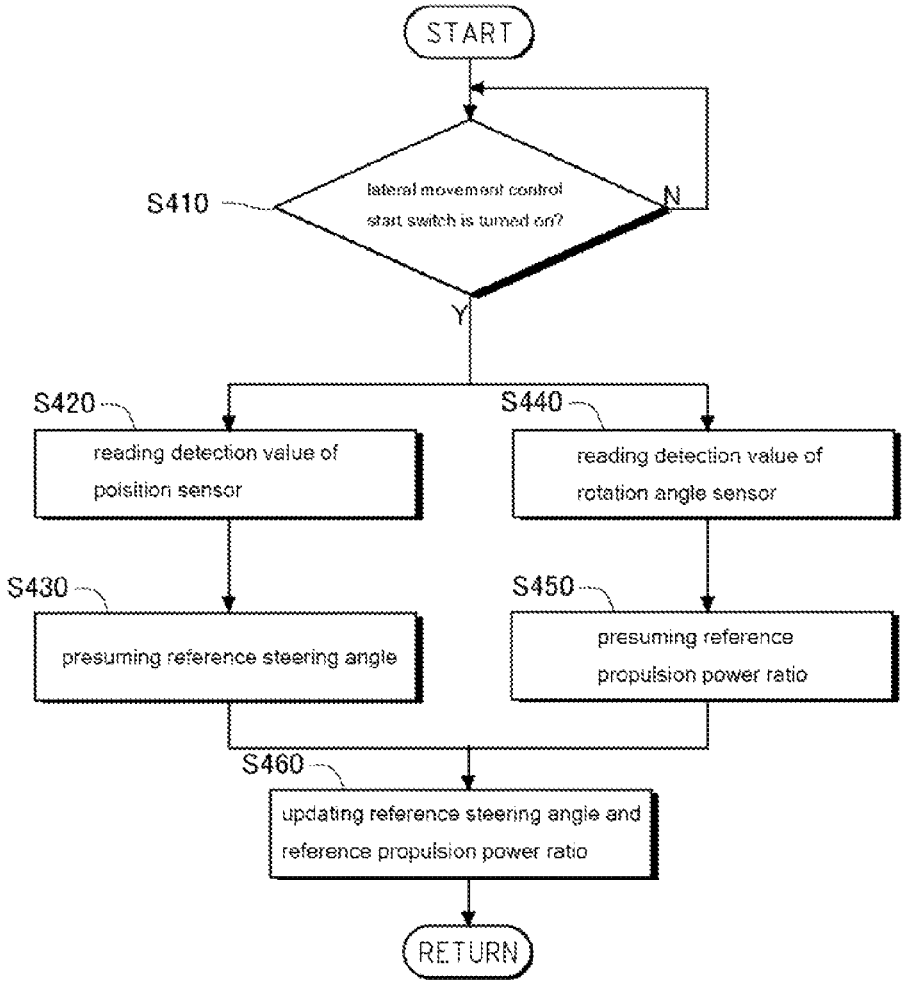
FIG. 10 is a flow chart of control concerning determination of a reference value during lateral movement.

Next, an explanation will be given on control concerning determination of the correction value during lateral movement with the control device 31 referring to FIG. 10. The calculation means 32 of the control device 31 performs the control as a correction value determination means.

Firstly, an explanation will be given on steps of an operator before starting the control concerning the determination of the reference value.

The operator operates the joystick 21 so as to make the ship travel laterally. For example, the operator operates the joystick 21 so as to be fallen down to a (+) direction of an X axis in FIG. 4.

When the ship does not travel leftward though the joystick 21 is fallen down to the (+) direction of the X axis, for example, when the ship turns (see FIG. 11(A)) or sails obliquely (see FIG. 12(A)), the joystick 21 is operated further so as to change falling-down amount and twisting amount of the joystick 21, whereby the ship is controlled to be moved laterally leftward.

Figure 11:
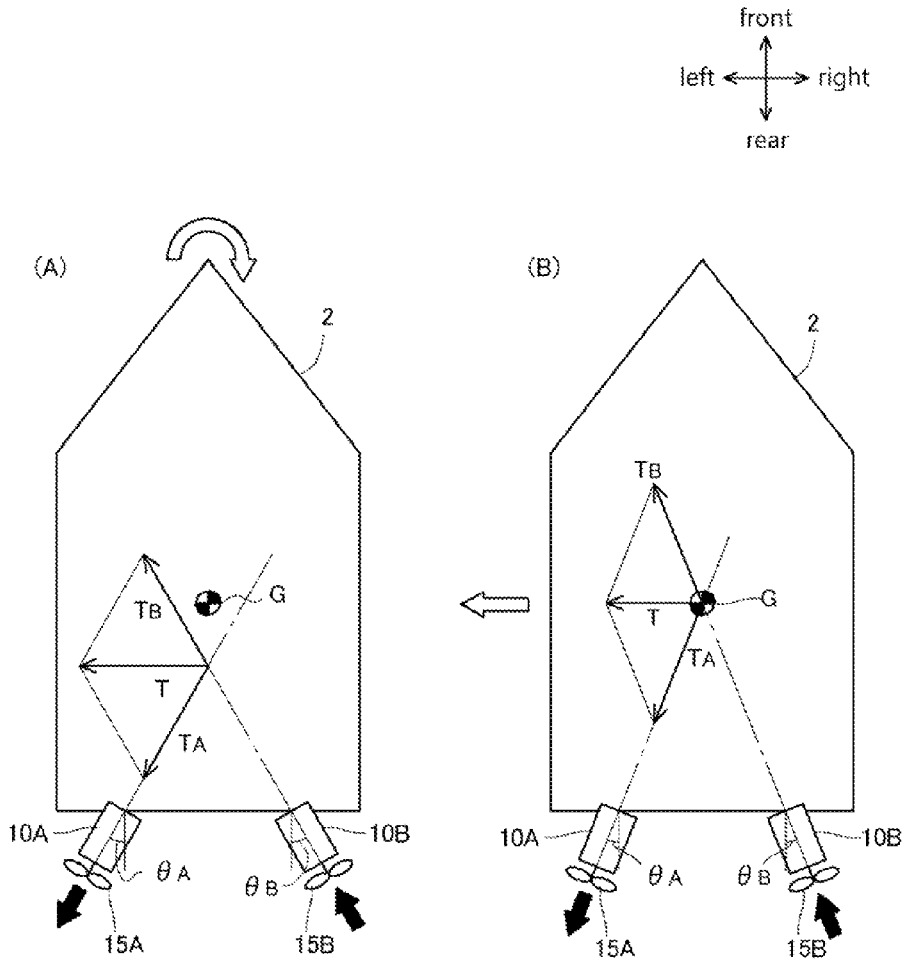
FIG. 11(A) is a drawing of behavior of the ship at a turning state.
FIG. 11(B) is a drawing of behavior of the ship at the time at which the ship is shifted from the turning state to a lateral movement state.
Figure 12:
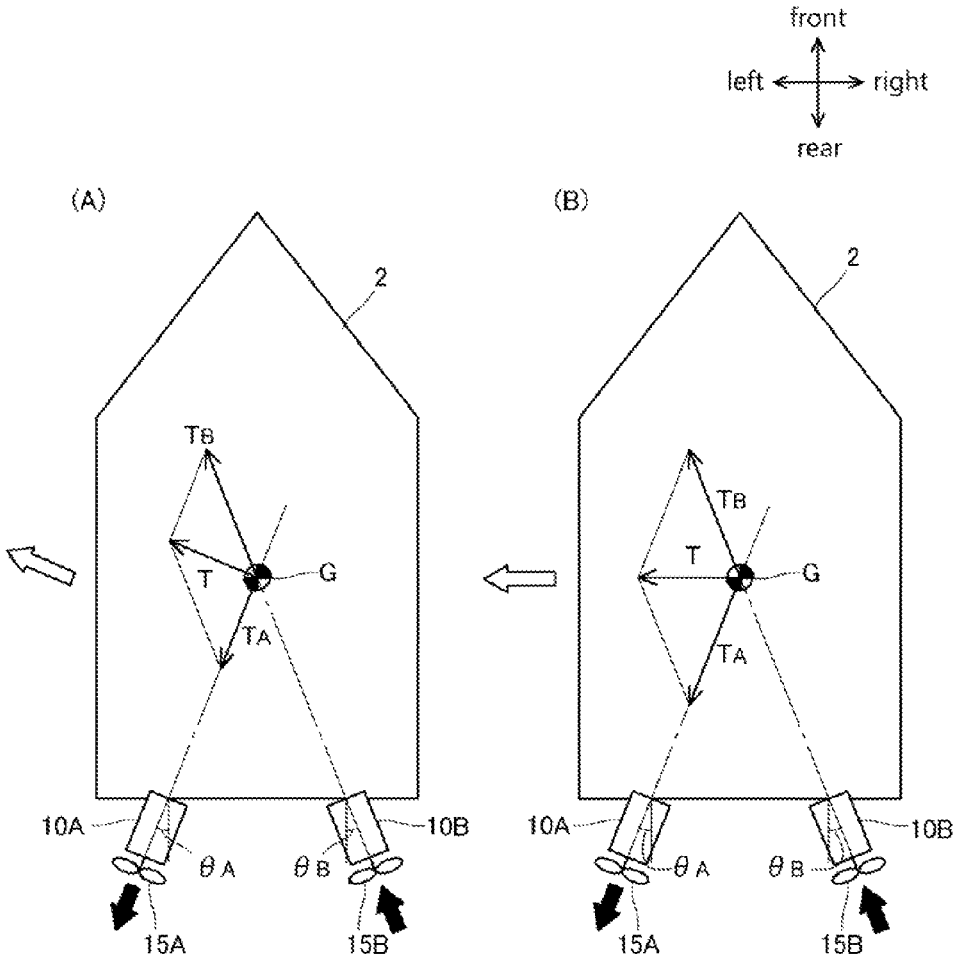
FIG. 12(A) is a drawing of behavior of the ship at a oblique sailing state.
FIG. 12(B) is a drawing of behavior of the ship at the time at which the ship is shifted from the oblique sailing to the lateral movement state.

As shown in FIGS. 11 and 12, in the pair of left and right outdrive devices 10A and 10B, the direction of the propulsion power of the left outdrive device 10A is slanted leftward concerning a direction of a stern, and the direction of the propulsion power of the right outdrive device 10B is slanted leftward concerning a direction of a bow. Namely, the direction of the propulsion power of the left outdrive device 10A is rearward and the direction of the propulsion power of the right outdrive device 10B is forward. The propulsion power of the left outdrive device 10A is referred to as $T_A$, the propulsion power of the right outdrive device 10B is referred to as $T_B$, and a total propulsion power is referred to as T. The total propulsion power T acts on an intersection of the direction of the propulsion power of the left outdrive device 10A and the direction of the propulsion power of the right outdrive device 10B. The total propulsion power T is a resultant of the propulsion power of the left outdrive device 10A and the propulsion power of the right outdrive device 10B.

As shown in FIG. 11(A), when the intersection of the direction of the propulsion power of the left outdrive device 10A and the direction of the propulsion power of the right outdrive device 10B is not in agreement with the centroid G of the ship, the total propulsion power T does not act on the centroid G of the ship. Accordingly, a moment by the total propulsion power T is generated around the centroid G of the ship, whereby the ship turns rightward (clockwise in plan view).

In this case, the joystick 21 is twisted to a (−) direction of a Z axis so as to change the rotation angle $\theta_A$ of the left outdrive device 10A and the rotation angle $\theta_B$ of the right outdrive device 10B. When the ship turns leftward (counterclockwise in plan view), the joystick 21 is twisted to the (+) direction of the Z axis. Accordingly, as shown in FIG. 11(B), the intersection of the direction of the propulsion power of the left outdrive device 10A and the direction of the propulsion power of the right outdrive device 10B becomes in agreement with the centroid G of the ship, and when the total propulsion power T acts on the centroid G of the ship, the ship is moved laterally leftward.

As shown in FIG. 12(A), when the propulsion power of the left outdrive device 10A is not equal to the direction of the propulsion power of the right outdrive device 10B, the total propulsion power T does not act to a direction to which the ship is wanted to be moved laterally, whereby the ship sails obliquely. For example, when the propulsion power of the left outdrive device 10A is smaller than the direction of the propulsion power of the right outdrive device 10B, the ship sails aslant leftward concerning the direction of the bow. Concerning the screw propellers 15A and 15B, when the rotation speed is fixed, the propulsion power generated by the forward rotation is different with the propulsion power generated by the reverse rotation. For example, when the rotation speed is fixed, the propulsion power of the forward rotation is larger than the propulsion power of the reverse rotation.

In this case, the joystick 21 is fallen down to a (−) direction of a Y axis while the falling-down amount in the (+) direction of the X axis is maintained so as to change the rotation speed of the left outdrive device 10A (the screw propeller 15A) or the rotation speed of the right outdrive device 10B (the screw propeller 15B). When the ship sails aslant leftward concerning the direction of the stern, the joystick 21 is fallen down to a (+) direction of the Y axis while the falling-down amount in the (+) direction of the X axis is maintained. Accordingly, as shown in FIG. 12(B), the propulsion power of the left outdrive device 10A becomes equal to the direction of the propulsion power of the right outdrive device 10B, and when the total propulsion power T acts to the direction to which the ship is wanted to be moved laterally, the ship is moved laterally leftward.

Next, when the ship is moved laterally leftward, the lateral movement control start switch 51 is turned on. When the lateral movement control start switch 51 is turned on, the control concerning the determination of the reference value is started. An explanation will be given on the control concerning the determination of the reference value referring to FIG. 10.

The control device 31 judges whether the lateral movement control start switch 51 is turned on or not (step S410), and performs the step S410 again when the lateral movement control start switch 51 is not turned on.

At the step S410, when the lateral movement control start switch 51 is judged to be turned on, the control device 31 reads detection values of the left lateral rotation angle detection sensor 38A and the right lateral rotation angle detection sensor 38B at the time at which the lateral movement control start switch 51 is turned on at a step S420. Then, the control device 31 grasps the rotation angle $\theta_A$ of the left outdrive device 10A based on the detection value of the left lateral rotation angle detection sensor 38A, and grasps the rotation angle $\theta_B$ of the right outdrive device 10B based on the detection value of the right lateral rotation angle detection sensor 38B.

At a step S430, the control device 31 calculates a reference steering angle (rotation angle of the outdrive devices 10A and 10B) at the time at which the lateral movement control start switch 51 is turned on. For example, the reference steering angle is an average value of the rotation angle $\theta_A$ of the left outdrive device 10A and the rotation angle $\theta_B$ of the right outdrive device 10B. The reference steering angle is the rotation angle of the outdrive devices 10A and 10B at the time at which the intersection of the direction of the propulsion power of the left outdrive device 10A and the direction of the propulsion power of the right outdrive device 10B is in agreement with the centroid G of the ship.

At a step S440, the control device 31 reads detection values of the left outdrive device rotation speed detection sensor 40A and the right outdrive device rotation speed detection sensor 40B at the time at which the lateral movement control start switch 51 is turned on. Then, the control device 31 grasps the outdrive device rotation speed $ND_A$ of the left outdrive device 10A based on the detection value of the left outdrive device rotation speed detection sensor 40A, and grasps the outdrive device rotation speed $ND_B$ of the right outdrive device 10B based on the detection value of the right outdrive device rotation speed detection sensor 40B.

At a step S450, the control device 31 presumes a reference propulsion power ratio at the time at which the lateral movement control start switch 51 is turned on. For example, the reference propulsion power ratio is a value found by dividing the outdrive device rotation speed $ND_A$ ($ND_B$) of the outdrive device 10A (10B) at the side of rearward traveling with the outdrive device rotation speed $ND_A$ ($ND_B$) of the outdrive device 10A (10B) at the side of forward traveling. In this embodiment, the reference propulsion power ratio is a value found by dividing the outdrive device rotation speed $ND_A$ of the left outdrive device 10A with the outdrive device rotation speed $ND_B$ of the right outdrive device 10B. The reference propulsion power ratio is a ratio of the outdrive device rotation speed $ND_A$ of the left outdrive device 10A and the outdrive device rotation speed $ND_B$ of the right outdrive device 10B at the time at which the propulsion power of the left outdrive device 10A is equal to the direction of the propulsion power of the right outdrive device 10B. The reference propulsion power ratio may alternatively be a value found by dividing the outdrive device rotation speed $ND_A$ ($ND_B$) of the outdrive device 10A (10B) at the side of forward traveling with the outdrive device rotation speed $ND_A$ ($ND_B$) of the outdrive device 10A (10B) at the side of rearward traveling.

After the reference steering angle and the reference propulsion power ratio are presumed at the steps S430 and S450, completion of the presumption of the reference steering angle and the reference propulsion power ratio is displayed on the display monitor 60. At the time at which the display is performed, when the operator pushes the lateral movement control start switch 51, the reference steering angle and the reference propulsion power ratio are stored in the storage means 33. Namely, the reference steering angle and the reference propulsion power ratio are updated (step S460). When the reference steering angle and the reference propulsion power ratio are stored in the storage means 33, a calibration concerning the determination of the reference value at the time of lateral movement of the hull 2 is finished. A calibration for rightward lateral movement of the ship is performed similarly.

The control concerning this embodiment is not limited to control in which all the steps S420, S430, S440 and S450 are performed, and may be control in which the steps S420 and S430 are performed and the steps S440 and S450 are not performed, or may alternatively be control in which the steps S440 and S450 are performed and the steps S420 and S430 are not performed.

As mentioned above, in the steering method of the ship having the pair of left and right outdrive devices 10A and 10B rotatable laterally and sailing with propulsion power of the outdrive devices 10A and 10B, the joystick 21 which is the operation means for actuating the outdrive devices 10A and 10B, the lateral movement control start switch 51 which is a confirmation means operated when the leftward or rightward lateral movement of the ship is confirmed, and the control device 31 to which the outdrive devices 10A and 10B, the joystick 21 and the lateral movement control start switch 51 are connected are used. The joystick 21 is operated and the outdrive devices 10A and 10B are actuated so as to move the ship laterally. The lateral movement control start switch 51 is operated when the leftward or rightward lateral movement of the ship is confirmed. The rotation angles of the outdrive devices 10A and 10B at the time of operating the lateral movement control start switch 51 (reference steering angle) is calculated with the control device 31.

According to the construction, only by operating the joystick 21 and the lateral movement control start switch 51, the reference steering angle at the time of lateral movement of the ship is set. Accordingly, the ship can be set easily to move laterally.

Then, using the outdrive device rotation speed detection sensor 40A detecting the rotation speed of the outdrive device 10A, the outdrive device rotation speed detection sensor 40B detecting the rotation speed of the outdrive device 10B, and the control device 31 to which the outdrive device rotation speed detection sensor 40A and the outdrive device rotation speed detection sensor 40B are connected, the ratio of the rotation speed of one of the outdrive devices 10A (10B) and the ratio of the rotation speed of the other outdrive device 10A (10B) at the time of operating the lateral movement control start switch 51 is calculated with the control device 31.

According to the construction, only by operating the joystick 21 and the lateral movement control start switch 51, the reference propulsion power ratio at the time of lateral movement of the ship is set. Accordingly, the ship can be set easily to move laterally.

The operation means according to the present invention is not limited to the joystick 21 according to this embodiment. For example, the operation means according to the present invention may alternatively be a lever which can be slanted along a cross direction, a plurality of levers, or a handle.

The confirmation means according to the present invention is not limited to the lateral movement control start switch 51 according to this embodiment. For example, the confirmation means according to the present invention may alternatively be a lever.

Industrial Applicability

The present invention can be used for an art of a ship having an inboard motor (inboard engine, outboard drive) in which a pair of left and right engines are arranged inside a hull and power is transmitted to a pair of left and right outdrive devices arranged outside the hull.

The invention claimed is:

1. A ship steering device comprising:

a pair of left and right engines;

rotation speed changing actuators independently changing engine rotation speeds of the pair of left and right engines;

a pair of left and right outdrive devices respectively connected to the pair of left and right engines and rotating screw propellers so as to propel a hull;

forward/reverse switching clutches disposed between the engines and the screw propellers;

a pair of left and right steering actuators respectively independently rotating the pair of left and right outdrive devices laterally;

an operation means setting a traveling direction of a ship;

an operation amount detection means detecting an operation amount of the operation means; and a control device controlling the rotation speed changing actuators, the forward/reverse switching clutches, and the steering actuators so as to travel to a direction set by the operation means, characterized in that the ship steering device further comprising:

a rotation speed detection means for the outdrive devices;

a lateral rotation angle detection means for the outdrive devices;

a propulsion power vector calculation means calculating propulsion power vectors from rotation speeds and lateral rotation angles of the outdrive devices;

a storage means in which a relation among propulsion power of the hull obtained from norms of the propulsion power vectors, an elevation angle of the hull obtained from angles of the propulsion power vectors, and a correction value is stored; and a correction value determination means, wherein the correction value is determined by the correction value determination means based on the operation amount by which the operation means is operated such that the hull does not turn in a state in which the hull is obliquely sailed.

* * * * *